US006325091B1

(12) United States Patent
Perrott et al.

(10) Patent No.: US 6,325,091 B1
(45) Date of Patent: Dec. 4, 2001

(54) WATER DISTRIBUTION APPARATUS FOR MULTIPLE SEWER DRAIN TRAP PRIMER SYSTEMS

(75) Inventors: Charles H. Perrott; Brian G. Weltman, both of Portland, OR (US)

(73) Assignee: Precision Plumbing Products, Inc., Portland, OR (US)

( * ) Notice: Subject to any disclaimer, the term of this patent is extended or adjusted under 35 U.S.C. 154(b) by 0 days.

(21) Appl. No.: 09/765,839

(22) Filed: Jan. 19, 2001

(51) Int. Cl.[7] ..... E03C 1/296
(52) U.S. Cl. ..... 137/247.25; 137/561 A
(58) Field of Search ..... 137/247.25, 118.05, 137/561 A

(56) References Cited

U.S. PATENT DOCUMENTS

| | | | | |
|---|---|---|---|---|
| 2,193,696 | * | 3/1940 | Ramsaur | 136/561 A X |
| 2,364,058 | * | 12/1944 | Burk et al. | 137/561 A |
| 2,373,099 | * | 4/1945 | Burk | 137/561 A |
| 3,776,269 | * | 12/1973 | Watts | 137/561 A |
| 3,899,000 | * | 8/1975 | Ohlswager et al. | 137/561 A |
| 4,256,140 | * | 3/1981 | Swaroop et al. | 137/561 A |
| 4,284,243 | * | 8/1981 | Shaner | 137/561 A X |
| 5,253,670 | | 10/1993 | Perrott . | |
| 5,287,877 | * | 2/1994 | Ackroyd | 137/118.05 |
| 5,678,588 | | 10/1997 | Perrott . | |
| 5,797,419 | * | 8/1998 | Perrott et al. | 137/118.05 X |
| 6,142,178 | * | 11/2000 | Whiteside | 137/561 A |
| 6,216,733 | * | 4/2001 | Sondov | 137/561 A |

* cited by examiner

*Primary Examiner*—John Rivell
(74) *Attorney, Agent, or Firm*—Olson and Olson

(57) ABSTRACT

An apparatus for distributing priming water equally to a multiplicity of sewer drain traps includes a hollow body member sealed with a top cap having a water inlet therethrough, the bottom of the body member provided with outlet fittings for connecting to a plurality of separate sewer line traps, each outlet fitting corresponding with a port communicating with the hollow interior of the body member, and a metering funnel member positioned in the hollow body member to receive water delivered from the water inlet, the metering funnel member arranged to deliver equal amounts of water received by the funnel member to each of the outlet ports and corresponding outlet fittings connected to a plurality of individual sewer line drain traps. Unused water outlets may be selectively plugged without adversely affecting continuous and even distribution of water received by the distribution apparatus to the remaining unplugged water outlets.

7 Claims, 2 Drawing Sheets

WATER DISTRIBUTION APPARATUS FOR MULTIPLE SEWER DRAIN TRAP PRIMER SYSTEMS

BACKGROUND OF THE INVENTION

This invention relates to sewer line drain trap priming systems and more particularly to a water distribution apparatus for multiple trap priming systems.

As is well known, most plumbing codes require that water be automatically supplied to sewer line drain traps to maintain the traps in an operative condition filled with water at all times. Various priming water distribution arrangements have been provided heretofore for accomplishing this purpose. Illustrative such assemblies are my earlier disclosures in U.S. Pat. No. 5,253,670, issued Oct. 19, 1993 and U.S. Pat. No. 5,678,588, issued Oct. 21, 1997. In the first of the two patents identified above, an elongated manifold pipe was provided with a multiplicity of individual metering port connections each of which having a specialized flow orifice of a particular size predetermined to equalize the flow of priming water from the manifold to each branch line connected to a sewer line trap. The second patent identified above provided a multiplicity of manifold units each provided with its own, individual pressure sensitive control valve operable to inject a charge of priming water into drain traps connected thereto upon a predetermined change in pressure in the water inlet lines supplying water to the pressure sensitive valves.

SUMMARY OF THE INVENTION

In its basic concept, this invention provides a water distribution apparatus for multiple drain trap priming systems for sewer lines, the distribution apparatus having a slotted, water-metering receptacle member contained within a hollow body housing, the receptacle member arranged to distribute priming water received thereby equally to each of a plurality of outlet ports on the body housing that are in turn connected to individual sewer line traps.

It is by virtue of the foregoing basic concept that the principal objective of this invention is achieved; namely, the provision of a distribution apparatus that maintains multiple sewer line drain traps in operatively primed condition using a minimal amount of water.

Another object of this invention is the provision of a distribution apparatus of the class described which also provides for easy and immediate inspection of its interior.

Another object of this invention is the provision of a distribution apparatus of the class described which accommodates both easy and economical installation as well as simplified installation that allows for a substantial degree of variation off of true level mounting orientation without adversely affecting optimum performance of the distribution apparatus.

Yet another object of this invention is the provision of a distribution apparatus of the class described in which one or more water outlets may be selectively plugged in cases where more water outlets are provided than sewer traps to be served, without adversely affecting continous and even distribution of water to the remaining unplugged water outlets of the distribution apparatus.

A further object of this invention is the provision of a distribution apparatus of the class described which is of simplified construction for economical manufacture and durability of operation.

The foregoing and other objects and advantages of the present invention will appear from the following detailed description, taken in connection with the accompanying drawings of a preferred embodiment.

DESCRIPTION OF THE PREFERRED EMBODIMENT

Figure 2:
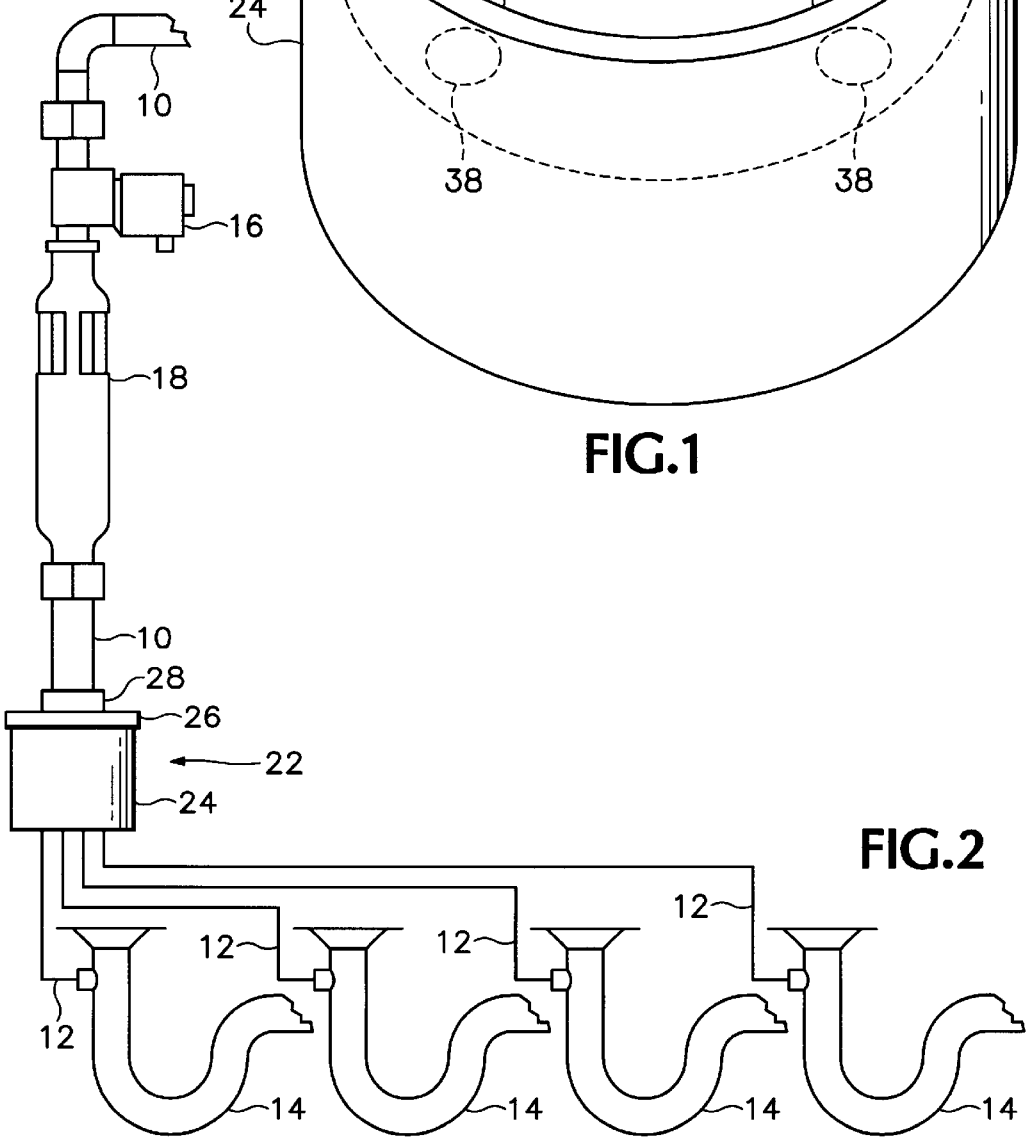
FIG. 2 is a fragmentary schematic view of a multiple drain trap primer valve assembly utilizing the distribution apparatus of this invention.

Referring to FIG. 2 of the drawings, a trap primer assembly for multiple sewer drain traps provides for delivery of predetermined amounts of domestic or commercial water from a main line 10 at predetermined time intervals to each of a plurality of primer branch lines 12 each of which in turn is connected to a corresponding one of a plurality of sewer drain traps 14 as is well known. A solenoid-actuated primer control valve 16 is provided in the main line 10 to control the flow of water into the priming system, this valve 16 typically being operated by a timer (not shown) set to allow a predetermined amount of water to pass through the valve at predetermined time intervals as desired or needed. When necessary or desired to prevent possible backup of sewer gases into the main line 10, an air gap 18 typically is also provided as shown. The presence of an air gap fitting 18 will also serve the usual function of preventing the undesirable presence of vacuum in the priming system which can result in contamination of the house or commercial main line 10 due to sewer water being drawn up through the branch lines 12, as is well known in the art.

Connected to the main line 10 downstream of the primer control valve 16 is the distribution apparatus 22 of this invention. As seen in FIG. 2 the distribution apparatus includes a body member 24 having a top cap 26 provided with an inlet fitting 28 for connection to the main line 10 served by the outlet of the primer control valve 16. In the embodiment illustrated, the body member serves four primer branch lines 12 which serve four independent sewer line drain traps 14 as will be described later.

Figure 1:
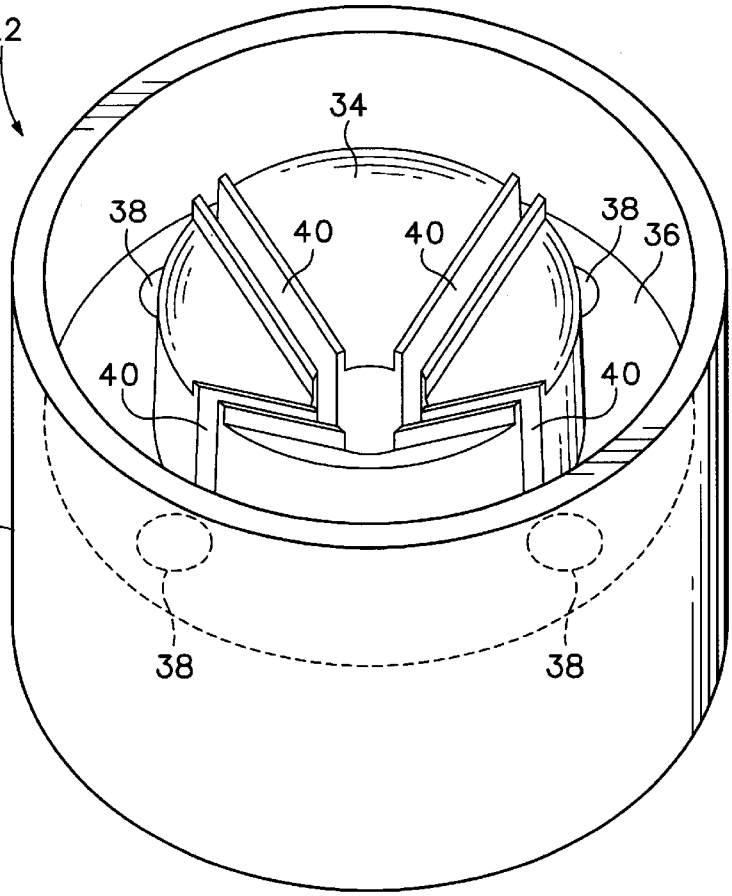
FIG. 1 is a perspective view of a distribution apparatus embodying features of this invention, the apparatus shown with its top cap removed to better show internal detail.
Figure 4:
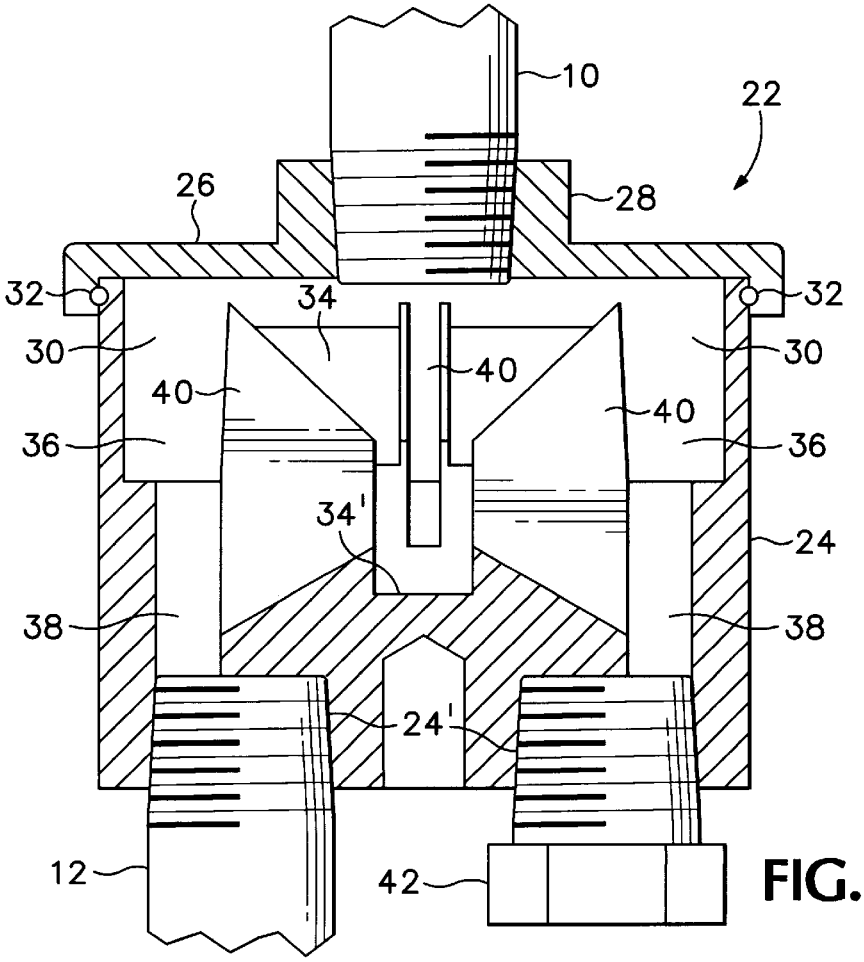
FIG. 4 is a fragmentary sectional view through the distribution apparatus taken along the line 4—4 in FIG. 3.

Referring now specifically to the distribution apparatus 22 and FIGS. 1 and 4 of he drawings, it will be apparent to those skilled in the art that the body member 24 includes an upper hollow interior portion 30 which is open through the top of the body member and closed by top cap member 26. An O-ring seal 32 may be provided between the top cap and the body member to assure a positive seal is accomplished if the top cap member 26 is removably attached to the body member rather than permanently affixed thereto. Preferably the top cap member 26 is provided in the form of a transparent member for ease of inspection of the interior of the body member without need of any disassembly for inspection purposes.

As seen most clearly in FIGS. 1 and 4 of the drawings, the hollow interior cavity of the body member includes a water-receiving distribution receptacle member 34 disposed under the water inlet fitting 28 through the top cap member 26. The distribution receptacle 34 is preferably, as illustrated, situated centrally within the hollow cavity 30 in order to provide an encircling water overflow channel 36 thereabout. In the preferred embodiment illustrated, the body member, water receiving distribution receptacle and overflow channel are generally circular in nature, although it will be apparent to those skilled in the art that other mutually-corresponding configurations of these elements may alternatively be utilized in order to accommodate more outlet branch lines 12 or other installation requirements as may be present.

Figure 3:
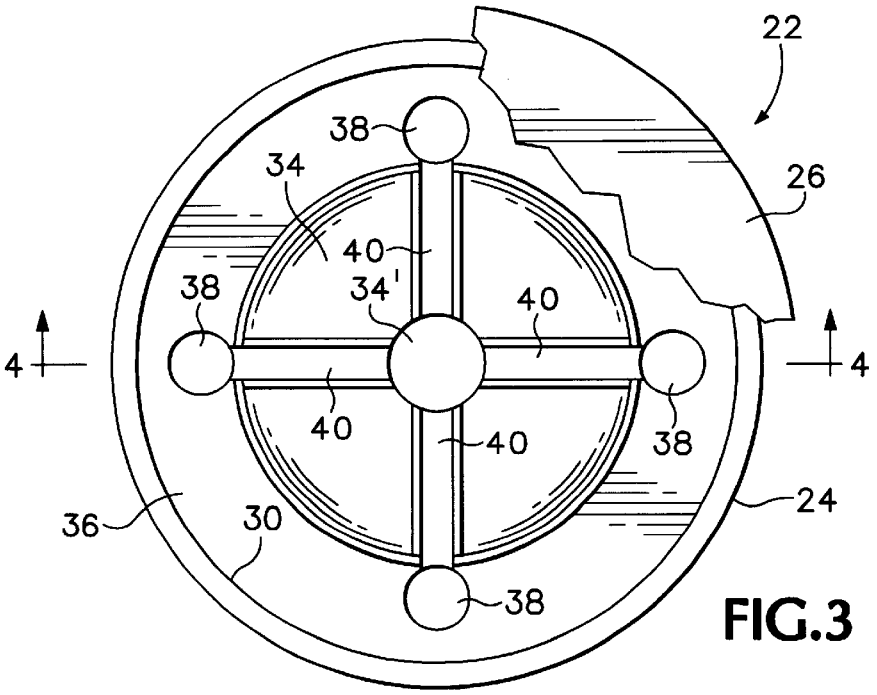
FIG. 3 is a plan view of the interior of the distribution apparatus of FIG. 1 as viewed from the top in FIG. 1.

As seen best in FIG. 4, the base of the body member 24 is provided with a plurality of water outlets 24' each configured to receive and a primer branch line 12. A plurality of corresponding, downwardly-extending outlet ports 38 are provided in the body member to connect each outlet fitting 24' with the receptacle-encircling overflow channel 36 in the upper hollow cavity of the body member, as seen in FIGS. 1, 3 and 4. In the preferred embodiment illustrated herein it will be seen that the water-receiving distribution receptacle 34 in this case is formed essentially as a conical funnel member with a closed bottom end 34'. The funnel member is provided with a plurality of slots 40 that form open channels through the walls of the funnel member, each channel directly aligning with a different one of the plurality of outlet ports 38 communicating the overflow channel to the primer branch lines 12. This arrangement provides water distribution means associated with the water-receiving receptable for distributing water received thereby equally and evenly to each one of the plurality of primer branch lines 12.

As will be apparent in viewing FIG. 1 of the drawings, all water contained in the funnel member 34 will flow in substantially metered fashion through channels 40 at precisely the same rate and volume, thereby assuring even distribution of water to each sewer trap priming line 12 connected thereto. Further, any water overflowing the funnel member will collect in the encircling overflow channel 36 in the body member cavity and be distributed evenly to each of the associated outlet ports 38 as well.

Plug means, such as plug member 42 shown in FIG. 4, may be provided for selectively closing unused water outlets 24' in the event that the number of water outlets on the body member exceeds the number of sewer trap priming lines 12 in a sewer system. As will be apparent in viewing FIG. 4 of the drawings, with a water outlet plugged as by the plug member 42, water available for that outlet will consequently be confined within the body where the volume of water is continuously and evenly distributed through the plurality of channel slots 40 and the overflow channel 36 to the remaining outlet ports 38 and associated unplugged water outlets 24'.

The operation of the distribution apparatus of this invention is readily apparent from the drawings and the foregoing description of the structure involved. Valve 16 is operated by a timer or other typical control means to open at predetermined preset times or under predetermined preset conditions to permit a predetermined amount of water from the main line 10 pass through into the priming system. Water is delivered through water inlet 28 into the water-receiving receptacle 34 contained within the hollow body 24 of the distribution apparatus. As the water receiving receptacle receives the water delivered thereto, the water is immediately and evenly distributed through the plurality of channel slots 40 to respective outlet ports 38, and there in turn to the individual primer branch lines 12 to the individual drain traps 14. As will be understood, if the slots 40 cannot channel the water from the receptacle 34 fast enough, any water overflowing the water receiving receptacle will spill into the circumferential overflow channel 36 and there in turn directed to individual outlet ports 38 as seen best in FIG. 1 of the drawings. Ideally however, water is channeled out of the water receiving receptacle 34 at approximately the same rate as water being delivered to the receptacle through the water inlet 28.

From the foregoing it will be apparent to those skilled in the art that various changes other than those already described may be made in the size, shape, type, number and arrangement of parts described hereinbefore without departing from the spirit of this invention and the scope of the appended claims.

We claim:

1. A water distribution apparatus for multiple drain trap primer valve systems that supply a predetermined amount of priming water at predetermined time intervals simultaneously to a multiplicity of sewer drain traps in a sewer system, the distribution apparatus comprising:

a) a substantially hollow body member having a water inlet arranged to deliver predetermined amounts of priming water at predetermined time intervals into the interior of said hollow body member, the body member also having a plurality of water outlets configured for connection to a plurality of primer lines each connected to a separate sewer drain trap member of a sewer system, b) a water-receiving distribution receptacle member disposed within said hollow body member and arranged therein to receive and contain water delivered through said water inlet, and c) metering means on said distribution receptacle member for metering said water received and contained in the distribution receptacle member to each said water outlets equally and evenly, whereby d) water received through said water inlet is delivered in substantially evenly-metered fashion to each said water outlet connected to a drain trap equally and evenly such that each said multiplicity of drain trap members receive a substantially equal portion of said predetermined amount of priming water delivered to said body member.

2. The water distribution apparatus of claim 1 wherein the hollow body member includes an overflow channel encircling said water-receiving distribution receptacle member and interconnecting all said water outlets, said overflow channel configured to receive water overflowing said water receiving distribution receptacle member and deliver said overflow evenly to each said plurality of water outlets.

3. The water distribution apparatus of claim 1 wherein said hollow body member includes a clear inspection portion arranged to permit visual inspection of the interior of the hollow body member at all times.

4. The water distribution apparatus of claim 1 wherein said metering means comprises a plurality of slots through the walls of the water receiving distribution receptacle member, each said slot aligned with a corresponding water outlet and configured to deliver water contained in the distribution receptacle member equally to said corresponding water outlets.

5. The water distribution apparatus of claim 4 including an overflow channel in the hollow body member encircling the water-receiving distribution receptacle member and interconnecting all said water outlets, said overflow channel configured to receive and deliver water overflowing said distribution receptacle member and deliver said overflow evenly to each said water outlets.

6. The water distribution apparatus of claim 5 wherein the plurality of water outlets on the body member exceeds a plurality of primer lines available for connection thereto, the body member including plug means for selectively closing at least one water outlet whereby water received through said water inlet and contained within said body member is continuously and evenly distributed to the remaining water outlets of the body member by said encircling overflow channel interconnecting all said water outlets.

7. The water distribution apparatus of claim 1 wherein the plurality of water outlets on the body member exceeds the plurality of primer lines available for connection thereto, the body member including plug means for selectively closing at least one water outlet whereby water received through said water inlet and contained within said body member is continuously and evenly distributed to the remaining water outlets of the body member.

* * * * *